US006518931B1

(12) United States Patent
Sievenpiper

(10) Patent No.: US 6,518,931 B1
(45) Date of Patent: Feb. 11, 2003

(54) VIVALDI CLOVERLEAF ANTENNA

(75) Inventor: Daniel Sievenpiper, Los Angeles, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 09/525,832

(22) Filed: Mar. 15, 2000

(51) Int. Cl.[7] ..... H01Q 13/10; H01Q 1/38; H01Q 13/00

(52) U.S. Cl. ..... 343/770; 343/767; 343/771

(58) Field of Search ..... 343/770, 767, 343/771, 860, 863, 700 R, 700 MS, 908, 708, 795, 768, 797

(56) References Cited

U.S. PATENT DOCUMENTS

| | | | | |
|---|---|---|---|---|
| 3,267,480 A | | 8/1966 | Lerner | 343/911 |
| 3,810,183 A | | 5/1974 | Krutsinger et al. | 343/708 |
| 3,961,333 A | | 6/1976 | Purinton | 343/872 |
| 4,150,382 A | | 4/1979 | King | 343/754 |
| 4,266,203 A | | 5/1981 | Saudreau et al. | 333/21 |
| 4,387,377 A | | 6/1983 | Kandler | 343/756 |
| 4,594,595 A | | 6/1986 | Struckman | 343/770 |
| 4,749,996 A | | 6/1988 | Tresselt | 343/700 |
| 4,782,346 A | | 11/1988 | Sharma | 343/795 |
| 4,843,400 A | | 6/1989 | Tsao et al. | 343/700 |
| 4,843,403 A | * | 6/1989 | Lalezari et al. | 343/767 |
| 4,853,704 A | * | 8/1989 | Diaz et al. | 343/767 |
| 4,905,014 A | | 2/1990 | Gonzalez et al. | |
| 5,021,795 A | | 6/1991 | Masiulis | 343/700 |
| 5,023,623 A | | 6/1991 | Kreinheder et al. | 343/725 |
| 5,081,466 A | * | 1/1992 | Bitter, Jr. | 343/767 |
| 5,115,217 A | | 5/1992 | McGrath et al. | 333/246 |
| 5,146,235 A | | 9/1992 | Frese | 343/895 |
| 5,158,611 A | | 10/1992 | Ura et al. | 106/499 |
| 5,268,701 A | * | 12/1993 | Smith | 343/767 |
| 5,287,118 A | | 2/1994 | Budd | 343/909 |

(List continued on next page.)

FOREIGN PATENT DOCUMENTS

| | | |
|---|---|---|
| DE | 196 00 609 A1 | 4/1997 |
| EP | 0 539 297 | 4/1993 |
| FR | 2 785 476 | 5/2000 |
| FR | 2 785 476 A1 | 5/2000 |
| GB | 2 281 662 | 3/1995 |
| GB | 2 328 748 | 3/1999 |
| WO | 94/00891 | 1/1994 |
| WO | 96/29621 | 9/1996 |
| WO | WO 98/21734 | 5/1998 |
| WO | WO 99/50929 | 10/1999 |
| WO | 99/50929 | 10/1999 |
| WO | WO 00/44012 | 7/2000 |

OTHER PUBLICATIONS

Balanis, C., "Aperture Antennas", *Antenna Theory, Analysis and Design*, 2nd Edition, (New York, John Wiley & Sons, 1997), Chap. 12, pp. 575–597.

(List continued on next page.)

*Primary Examiner*—Don Wong
*Assistant Examiner*—Chuc Tran
(74) *Attorney, Agent, or Firm*—Ladas & Parry

(57) ABSTRACT

An antenna for receiving and/or transmitting a radio frequency wave. The antenna includes a plurality of flared notch antennas disposed adjacent to each other and arranged such that their directions of maximum gain point in different directions, each of the flared notch antennas being associated with a pair of radio frequency radiating elements and wherein each radio frequency radiating element serves as a radio frequency radiating element for two different flared notch antennas and has a gap therein having a length equal to approximately one quarter wavelength of the radio frequency wave.

63 Claims, 10 Drawing Sheets

U.S. PATENT DOCUMENTS

| | | | | | |
|---|---|---|---|---|---|
| 5,519,408 | A | * | 5/1996 | Schnetzer | 343/767 |
| 5,525,954 | A | | 6/1996 | Komazaki et al. | 333/219 |
| 5,531,018 | A | | 7/1996 | Saia et al. | 29/622 |
| 5,534,877 | A | | 7/1996 | Sorbello et al. | 343/700 |
| 5,541,614 | A | | 7/1996 | Lam et al. | |
| 5,557,291 | A | | 9/1996 | Chu et al. | 343/725 |
| 5,589,845 | A | | 12/1996 | Yandrofski et al. | 343/909 |
| 5,611,940 | A | | 3/1997 | Zettler | 73/514 |
| 5,638,946 | A | | 6/1997 | Zavracky | 200/181 |
| 5,694,134 | A | | 12/1997 | Barnes | 343/700 |
| 5,721,194 | A | | 2/1998 | Yandrofski et al. | 505/210 |
| 5,874,915 | A | | 2/1999 | Lee et al. | 342/375 |
| 5,894,288 | A | | 4/1999 | Lee et al. | 343/770 |
| 5,923,303 | A | | 7/1999 | Schwengler et al. | |
| 5,945,951 | A | | 8/1999 | Monte et al. | 343/700 |
| 5,949,382 | A | * | 9/1999 | Quan | 343/767 |
| 6,005,519 | A | | 12/1999 | Burns | 343/700 |
| 6,040,803 | A | | 3/2000 | Spall | 343/700 |
| 6,054,659 | A | | 4/2000 | Lee et al. | 200/181 |
| 6,075,485 | A | | 6/2000 | Lilly et al. | 343/700 |
| 6,081,235 | A | | 6/2000 | Romanofsky et al. | 343/700 |
| 6,097,263 | A | | 8/2000 | Mueller et al. | 333/17.1 |
| 6,097,343 | A | | 8/2000 | Goetz et al. | 343/708 |
| 6,118,406 | A | | 9/2000 | Josypenko | 343/700 |
| 6,127,908 | A | | 10/2000 | Bozler et al. | 333/246 |
| 6,154,176 | A | | 11/2000 | Fathy et al. | 343/700 |
| 6,166,705 | A | | 12/2000 | Mast et al. | 343/853 |
| 6,175,337 | B1 | | 1/2001 | Jasper, Jr. et al. | 343/770 |
| 6,191,724 | B1 | | 2/2001 | McEwan | 342/21 |
| 6,246,377 | B1 | * | 6/2001 | Aiello et al. | 343/770 |

OTHER PUBLICATIONS

Balanis, C., "Microstrip Antennas", *Antenna Theory, Analysis and Design*, 2nd Edition, (New York, John Wiley & Sons, 1997), Chap. 14, pp. 722–736.

Cognard, J., "Alignment of Nematic Liquid Crystals and Their Mixtures" *Mol. Cryst. Lig, Cryst. Suppl. 1*, 1(1982)pp. 1–74.

Doane, J.W., et al., "Field Controlled Light Scattering from Nematic Microdroplets", *Appl. Phys. Lett.*, vol. 48 (Jan. 1986) pp. 269–271.

Jensen, M.A., et al., "EM Interaction of Handset Antennas and a Human in Personal Communications", *Proceedings of the IEEE*, vol. 83, No. 1 (Jan. 1995) pp. 7–17.

Jensen, M.A., et al., "Performance Analysis of Antennas for Hand–Held Transceivers Using FDTD", *IEEE Transactions on Antennas and Propagation*, vol. 42, No. 8 (Aug. 1994) pp. 1106–1113.

Ramo, S., et al., *Fields and Waves in Communication Electronics*, 3rd Edition (New York, John Wiley & Sons, 1994) Section 9.8–9.11, pp. 476–487.

Sievenpiper, D., et. al., "High–Impedance Electromagnetic Surfaces with a Forbidden Frequency Band", *IEEE Transactions on Microwave Theory and Techniques*, vol. 47, No. 11, (Nov. 1999) pp. 2059–2074.

Sievenpiper, D., "High–Impedance Electromagnetic Surfaces", *Ph.D. Dissertation*, Dept. of Electrical Engineering, University of California, Los Angeles, CA, 1999.

Wu, S.T. , et al., "High Birefringence and Wide Nematic Range Bis–tolane Liquid Crystals", *Appl. Phys. Lett.* vol. 74, No. 5, (Jan. 1999) pp. 344–346.

Linardou, I. et al., "Twin Vivaldi antenna fed by coplanar waveguide", *Electronics Letters, GB, IEE Stevenage*, vol. 33, No. 22, pp. 1835–1837 (1997).

Vaughan, Mark J., et al., "InP–Based 28 GHz Integrated Antennas for Point–to–Multipoint Distribution", *IEEE*, pp. 75–84 (1995).

Ellis, T.J. and G.M. Rebeiz, "MM–Wave Tapered Slot Antennas on Micromachined Photonic Bandgap Dielectrics," *1996 IEEE MTT–S International Microwave Symposium Digest*, vol. 2, pp. 1157–1160 (1996).

Linardou, I., et al., "Twin Vivaldi antenna fed by coplanar waveguide," *Electronics Letters*, vol. 33, No. 22, pp. 1835–1837 (Oct. 23, 1997).

Schaffner, J.H., et al., "Reconfigurable Aperture Antennas Using RF MEMS Switches for Multi–Octave Tunability and Beam Steering," *IEEE*, pp. 321–324 (2000).

Sievenpiper, D., et al., "Low–profile, four–sector diversity antenna on high–impedance ground plane," *Electronics Letters*, vol. 36, No. 16, pp. 1343–1345 (Aug. 3, 2000).

Sievenpiper, D. and Eli Yablonovitch, "Eliminating Surface Currents with Metallodielectric Photonic Crystals," *1998 IEEE MTT–S International Microwave Symposium Digest*, vol. 2, pp. 663–666 (Jun. 7, 1998).

Bradley, T.W., et al., "Development of a Voltage–Variable Dielectric (VVD), Electronic Scan Antenna," *Radar 97*, Publication No. 449, pp. 383–385 (Oct. 1997).

* cited by examiner

VIVALDI CLOVERLEAF ANTENNA

TECHNICAL FIELD

The present invention relates to a new antenna design. The antenna is directional and is preferably of a thin, flat construction. The antenna has multiple elements which provide directivity. The antenna may be flush-mounted on a high impedance surface. The antenna may be used with beam diversity hardware, for example, to improve the signal transmission and reception of wireless communications. Since the antenna may be flush-mounted, it can advantageously used on a mobile platform such as an automobile, a truck, a ship, a train or an aircraft.

BACKGROUND OF THE INVENTION

Prior art antennas and technology includes:

T. Schwengler, P. Perini, "Combined Space and Polarization Diversity Antennas", U.S. Pat. No. 5,923,303, Jul. 13, 1999. An antenna system with both spatial and polarization diversity has a first antenna aperture and a second antenna aperture, with a polarization separation angle being formed by the difference between the polarization angle of the first antenna aperture and the polarization angle of the second antenna aperture, and a vertical separation being formed by mounting the second antenna aperture a vertical distance above the first antenna aperture, such that diversity gain is achieved by both the polarization angle and the vertical distance. The combination of spatial and polarization diversity allows closer antenna aperture spacing and non-orthogonal polarization angles. However, using current techniques, antennas having both polarizations can not lie in a single plane—so the resulting antenna is not a low-profile antenna like the antenna disclosed herein.

M. Schnetzer, "Tapered Notch Antenna Using Coplanar Waveguide" U.S. Pat. No. 5,519,408. Tapered notch antennas, which are sometime known as Vivaldi antennas, may be made using standard printed circuit technologies.

D. Sievenpiper, E. Yablonovitch, "Circuit and Method for Eliminating Surface Currents on Metals" U.S. Provisional patent application, serial number 60/079953, filed on Mar. 30, 1998.

It is also known it the prior art to place a conformable end-fire antenna or array on a Hi-Z surface. It has been shown that the Hi-Z material can allow flush-mounted antennas to radiate in end-fire mode, with the radiation exiting the surface at a small angle with respect to the horizon.

Conventional vehicular antennas consist of a vertical monopole which protrudes from the metallic exterior of vehicle, or a dipole embedded in the windshield or other window. Both antennas are designed to have an omnidirectional radiation pattern so signals from all directions can be received. One disadvantage of omnidirectional antennas is that they are particularly susceptible to interference and fading, caused by either unwanted signals from sources other than the desired base station, or by signals reflected from vehicle body and other objects in the environment in a phenomenon known as multipath. Antenna diversity, in which several antennas are used with a single receiver, can be used to help overcome multipath problems. The receiver utilizing antenna diversity switches between the antennas to find the strongest signal. In more complicated schemes, the receiver can select a linear combination of the signals from all antennas.

The disadvantage of antenna diversity is the need for multiple antennas, which can lead to an unsightly vehicle with poor aerodynamics. Many geometries have been proposed which reduce the profile of the antenna, including patch antennas, planar inverted F-antennas, slot antennas, and others. Patch and slot antennas are described by, C Balanis, *Antenna Theory, Analysis and Design,* 2nd ed., John Wiley & Sons, New York (1997). Planar inverted F-antennas are described by M. A. Jensen and Y. Rahmat-Samii, "Performance analysis of antennas for handheld transceivers using FDTD," *IEEE Trans. Antennas Propagat.,* vol. 42, pp. 1106–1113, August 1994. These antennas all tend to suffer from unwanted surface wave excitation and the need for thick substrates or cavities.

As such, there is a need for an antenna which has low profile and has sufficient directivity to take advantage of antenna diversity. Preferably the antenna should not suffer from the effects of surface waves on the metal exterior of the vehicle.

The high impedance (Hi-Z) surface,which is the subject of U.S. Ser. No. 60/079953 mentioned above, provides a means of fabricating very thin antennas, which can be mounted directly adjacent to a conductive surface without being shorted out. Near the resonance frequency, the structure exhibits high electromagnetic impedance. This means that it can accommodate non-zero tangential electric fields at the surface of a low-profile antenna, and can be used as a shielding layer between the metal exterior of a vehicle and the antenna. The totals height is typically a small fraction of a wavelength, making this technology particularly attractive for mobile communications, where size and aerodynamics are important. Another property of this Hi-Z material is that it is capable of suppressing the propagation of surface waves. Surface waves normally exist on any metal surface, including the exterior metal skin of a vehicle, and can be a source of interference in many antenna situations. Surrounding the antenna with a small area of Hi-Z surface can shield the antenna from these surface waves. This has been shown to reduce multipath interference caused by scattering from ground plane edges.

The present application is related to (i) U.S. patent application Ser. No. 09/520,503 entitled "A Polarization Converting Radio Frequency Reflecting Surface" filed Mar. 8, 2000, and to (ii) U.S. patent application Ser. No. 09/525,831 entitled "Planar Antenna with Switched Beam Diversity for Interference Reduction in a Mobile Environment" filed Mar. 15,2000, the disclosures of which are hereby incorporated herein by this reference.

The Hi-Z surface, which is the subject matter of U.S. patent application Ser. No. 60/079,953 and which is depicted in FIG. 1*a,* includes an array of resonant metal elements 12 arranged above a flat metal ground plane 14. The size of each element is much less than the operating wavelength. The overall thickness of the structure is also much less than the operating wavelength. The presence of the resonant elements has the effect of changing the boundary condition at the surface, so that it appears as an artificial magnetic conductor, rather than an electric conductor. It has this property over a bandwidth ranging from a few percent to nearly an octave, depending on the thickness of the structure with respect to the operating wavelength. It is somewhat similar to a corrugated metal surface 22 (see FIG. 1*b*), which has been known to use a resonant structure to transform a short circuit into an open circuit. Quarter wavelength slots 24 of a corrugated surface 22 are replaced with lumped circuit elements in the Hi-Z surface, resulting in a much thinner structure, as is shown in FIG. 1*a*. The Hi-Z surface can be made in various forms, including a multi-layer structure with overlapping capacitor plates. Preferably the Hi-Z structure is formed on a printed circuit board (not shown in FIG. 1*a*) with the elements 12 formed on one major surface thereof and the ground plane 14 formed on the other major surface thereof. Capacitive loading allows a frequency be lowered for a given thickness. Operating frequencies ranging from hundreds of megahertz to tens of gigahertz have been demonstrated using a variety of geometries of Hi-Z surfaces.

It has been shown that antennas can be placed directly adjacent the Hi-Z surface and will not be shorted out due to the unusual surface impedance. This is based on the fact that the Hi-Z surface allows a non-zero tangential radio frequency electric field, a condition which is not permitted on an ordinary flat conductor.

BRIEF DESCRIPTION OF THE INVENTION

In one aspect the present invention provides an antenna comprising a plurality of flared notch antennas disposed immediately adjacent each other. Each flared notch antenna has a direction of maximum gain which is directed in a different direction for each flared notch antenna and is defined by a pair of confronting elements, each confronting element being associated with two different ones of the plurality of flared notch antennas. Each confronting element has a gap therein having a length which is approximately equal to a quarter wave length of a radio frequency signal to be received and/or transmitted by the antenna.

In another aspect the present invention provides an antenna comprising a high impedance surface; and a plurality of Vivaldi flared notch antennas disposed immediately adjacent the high impedance surface. Each Vivaldi Flared notch antenna is formed by two generally planar conductive elements disposed in a confronting relationship, with a feed point being defined therebetween. Each Vivaldi flared notch antenna shares each of its two planar elements with a different adjacent Vivaldi flared notch antenna.

In yet another aspect the present invention provides an antenna for receiving and/or transmitting a radio frequency wave, the antenna including a plurality of flared notch antennas disposed adjacent to each other and arranged such that their directions of maximum gain point in different directions. Each of the flared notch antennas is associated with a pair of radio frequency radiating elements and each radio frequency radiating element (i) serves as a radio frequency radiating element for two different flared notch antennas and (ii) has a gap therein having a length equal to approximately one quarter wavelength of the radio frequency wave.

BRIEF DESCRIPTION OF THE DRAWINGS

FIG. 1*a* is a perspective view of a Hi-Z surface;

FIG. 1*b* is a perspective view of a corrugated surface;

DETAILED DESCRIPTION OF THE INVENTION

The present invention provides an antenna, which is thin and which is capable of switched-beam diversity operation for improved antenna performance in gain and in directivity. When used in a switched-beam application, the present antenna design offers a practical way to provide an improved signal/interference ratio for wireless communication systems operating in a mobile environment, for example. The antenna may have a horizontal profile, so it can be easily incorporated into the exterior of vehicle for both aerodynamics and style. It can be effective at suppressing multipath interference, and it can also be used for anti-jamming purposes.

The antenna includes an array of thin antenna elements which are preferably mounted on a Hi-Z ground plane. The Hi-Z ground plane provides two features: (1) it allows the antenna to lie directly adjacent to the metal exterior of the vehicle without being shorted out and (2) it can suppress surface waves within the operating band of the antenna.

The Vivaldi Cloverleaf antenna disclosed herein provides, in effect, several antennas which can be used to separately address different directions. Each individual antenna preferably has a particular directivity and this directivity impacts the number of beams which can be conveniently formed. For example, the total omnidirectional radiation pattern can be divided into several sectors with different antennas forming the disclosed Vivaldi Cloverleaf antenna addressing different sectors. Each individual antenna in the array can then address a single sector. Thus, a Vivaldi Cloverleaf antenna which effectively comprises four antennas may be conveniently used in an array since each such antenna has a directivity that is four times better than an omnidirectional monopole antenna.

Figure 2:
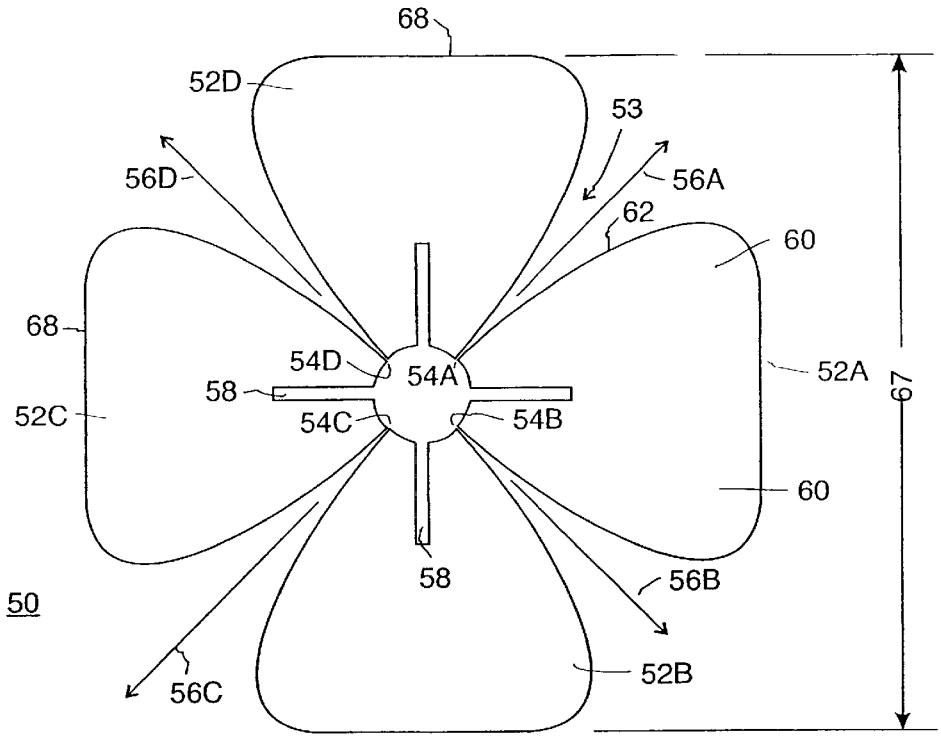
FIG. 2 is a plan view of a Vivaldi Cloverleaf antenna according to one aspect of the present invention.

FIG. 2 is a plan view of the aforementioned Vivaldi Cloverleaf antenna 50. In this embodiment, it is formed of an array or group of four antenna elements 52A, 52B, 52C and 52D which in effect form four different antennas. The four elements 52 have four feed points 54A, 54B, 54C and 54D therebetween and the antenna 50 has four different directions 56A, 56B, 56C and 56D of greatest gain, one associated with each feed point. However, the antenna may have more than or fewer than four elements 52, if desired, with a corresponding change in the number of feed points 54. The impedance at a feed point is compatible with standard 50Ω radio frequency transmitting and receiving equipment. The number of elements 52 making up the antenna is a matter of design choice. While the inventors have only made antennas with four elements 52 to date, they expect that antennas with a greater number of elements 52 could be designed to exhibit greater directivity, but would require a larger area and a greater number of feed points. Those skilled in the art will appreciate that better directivity could be an advantage, but that larger area and a more complex feed structure could be undesirable for certain applications.

Figure 2A:
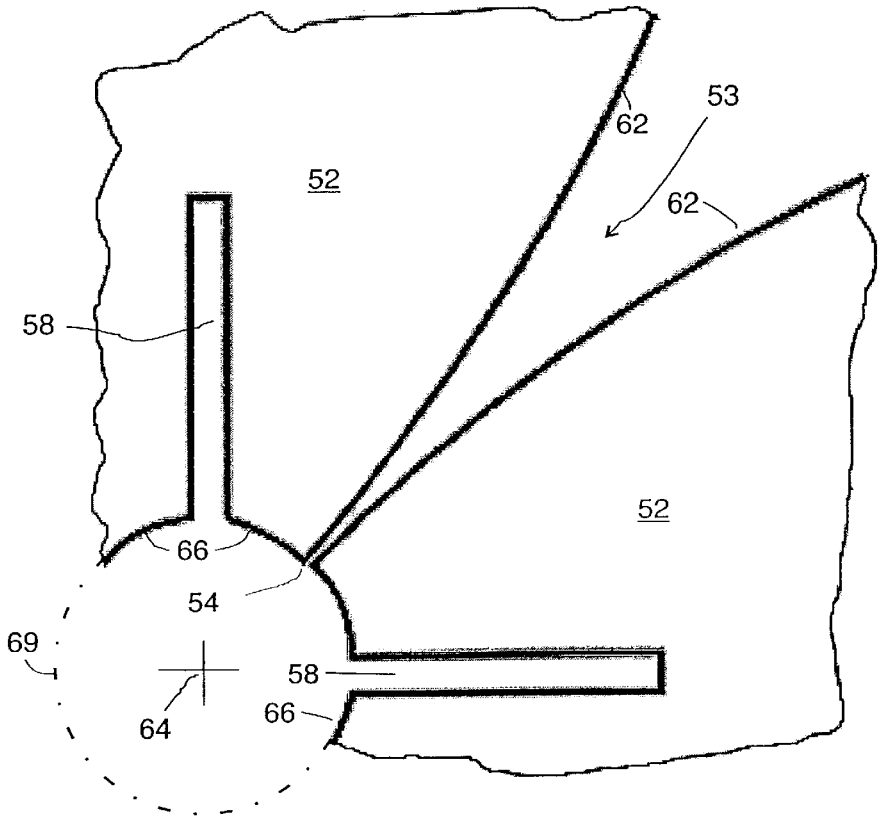
FIG. 2*a* is a detailed view of the Vivaldi Cloverleaf antenna at one of its feed points.

FIG. 2*a* is a detailed partial view of two adjacent elements 52 and the feed point 54 therebetween. The feed points 54 are located between adjacent elements 52 and conventional unbalanced shielded cable may be used to couple the feed points to radio frequency equipment used with the antenna.

Each element 52 is partially bisected by a gap 58. The gap 58 has a length of about ¼ of a wavelength (λ) for the center frequency of interest. The gap 58 partially separates each element 52 into two lobes 60 which are connected at the outer extremities 68 of an element 52 and beyond the extent of the gap 58. The lobes 60 of two adjacent elements 58 resemble to some extent a conventional Vivaldi notch antenna in that the edges 62 of the confronting, adjacent lobes 60 preferably assume the shape of a smooth departing curve. This shape of this curve can apparently be logarithmic, exponential, elliptic, or even be of some other smooth shape. The curves defining the edges 62 of adjacent lobes 60 diverge apart from the feed point 54. The elements 52 are arranged about a center point 64 and their inner extremities 66 preferably lie on the circumference 69 of a circle centered on a center point 64. The elements 52 extend in a generally outward direction from a central region generally defined by circumference 69. The feed points 54 are also preferably located on the circumference of that circle and therefore each are located between (i) where the inner extremity 66 of one element 52 meets one of its edges 62 and (ii) where the inner extremity 66 of an adjacent element 52 meets its edge 62 which confronts the edge 62 of first mentioned element 52.

Figure 4:
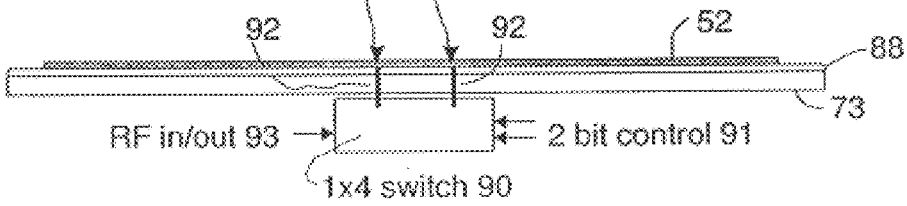
FIG. 4 is a elevation view of the antenna and Hi-Z surface shown in FIG. 3.

The antenna 50 just described can conveniently be made using printed circuit board technology and therefore is preferably formed on an insulating substrate 88 (see FIG. 4).

Each element 52 is sized for the center frequency of interest. For example, if the antenna thus described were to be used for cellular communications services in the 1.8 Ghz band, then the length of the gap 58 in each element 52 is preferably about ¼ of a wavelength for the frequency of interest (1.8 Ghz in this example) and each element has a width of about 10 cm and a radial extent from its inner extremity 66 to its outer extremity 68 of about 11 cm. The antenna is remarkably wide banded and therefore these dimensions and the shape of the antenna can be varied as needed and may be adjusted according to the material selected as the insulating substrate and whether the antenna 50 is mounted adjacent a high impedance (Hi-Z) surface 70 (see FIGS. 3 and 4). The outer extremity 68 is shown as being rather flat in the figures, however, it may be rounded if desired.

Since the preferred embodiment has four elements 52 and since each pair of elements 52 forms a Vivaldi-like antenna we occasionally refer to this antenna as the Vivaldi Cloverleaf antenna herein, it being recognized that the Vivaldi Cloverleaf antenna can have fewer than four elements 52 or more than four elements 52 as a matter of design choice.

Figure 3:
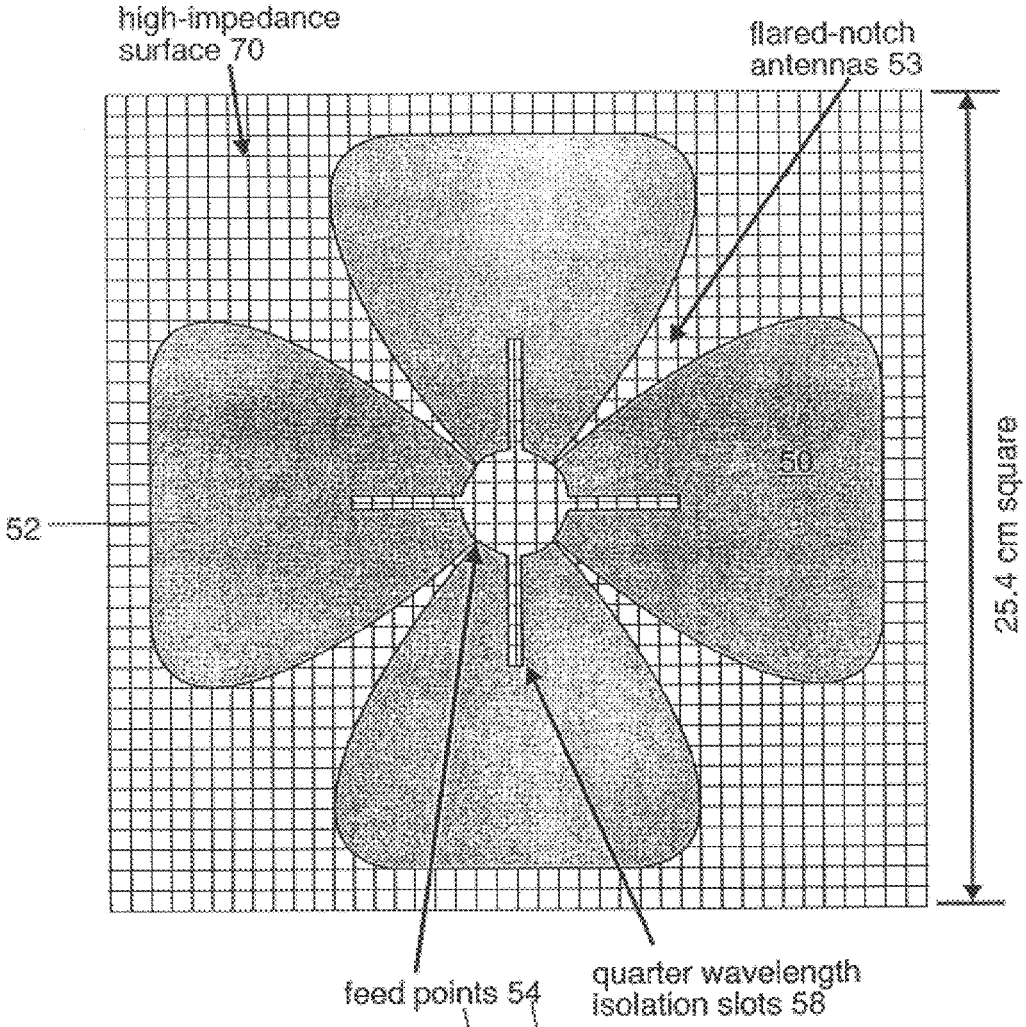
FIG. 3 depicts the Vivaldi Cloverleaf antenna disposed against a Hi-Z surface in plan view.

The Vivaldi Cloverleaf antenna 50 is preferably mounted adjacent a high impedance (Hi-Z) surface 70 as shown in FIGS. 3 and 4, for example. In prior art vehicular antennas the radiating structures are typically separated by at least one-quarter wavelength from nearby metallic surfaces. This constraint has severely limited where antenna could be placed on a vehicle and more importantly their configuration. In particular, prior art vehicular antennas tended to be non-aerodynamic in that they tended to protrude from the surface of the vehicle or they were confined to dielectric surfaces, such as windows, which often led to designs which were not particularly well suited to serving as omnidirectional antennas.

By following a simple set of design rules (see U.S. patent application Ser. No. 09/520,803 entitled "A Polarization Converting Radio Frequency Reflecting Surface" filed, Mar. 8, 2000 mentioned above) one can engineer the band gap of the Hi-Z surface to prevent the propagation of bound surface waves within a particular frequency band. Within this band gap, the reactive electromagnetic surface impedance is high (>377Ω), rather than near zero as it is for a smooth conductor. This allows antenna 50 to lie directly adjacent to the Hi-Z surface 70 without being shorted out as it would if placed adjacent a metal surface. The Hi-surface Z 70 may be backed by continuous metal such as the exterior metal skin of automobile, truck, airplane or other vehicle. The entire structure of the antenna 50 plus high impedance surface 70 is much thinner than the operating wavelength, making it low-profile, aerodynamic, and moreover easily integrated into current vehicle styling. Furthermore it is amenable to low-cost fabrication using standard printed circuit techniques.

Figure 5:
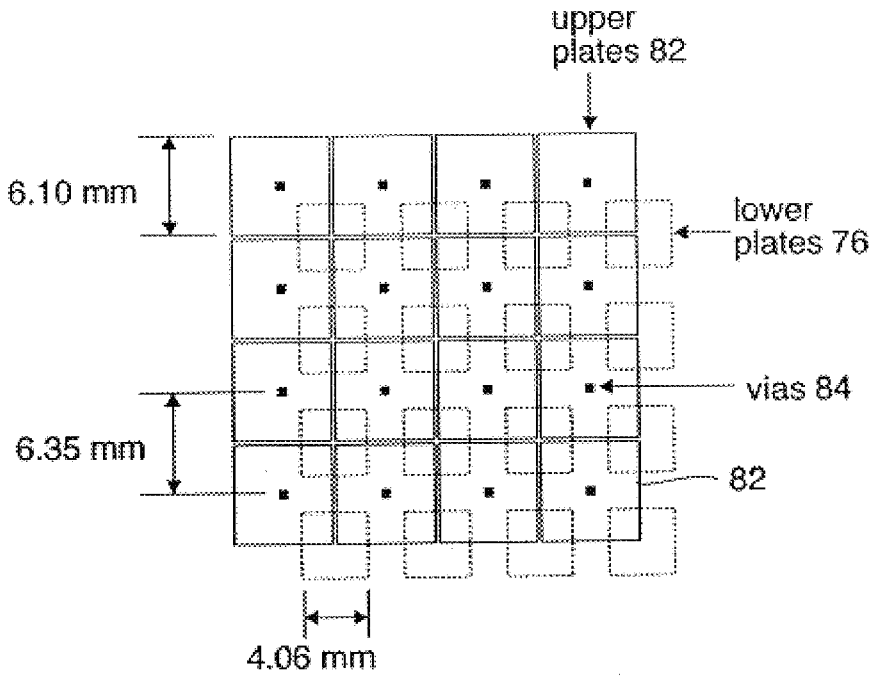
FIG. 5 is a schematic plan view of a small portion of a three layer high impedance surface.
Figure 6:
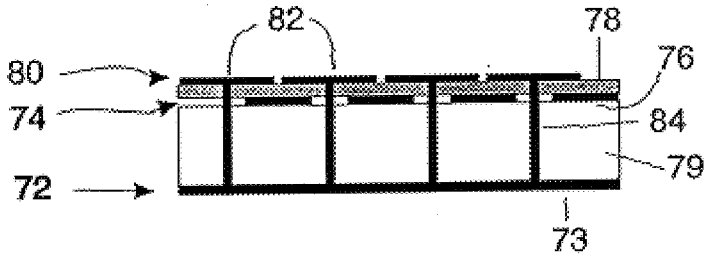
FIG. 6 is a side elevational view of the three layer high impedance surface of FIG. 5.

Tests have been performed on a high impedance surface 70 comprising a three-layer printed circuit board in which the lowest layer 72 provides solid metal ground plane 73, and the top two layers contain square metal patches 76, 82. See FIGS. 5 and 6. The upper layer 80 is printed with 6.10 mm square patches 82 on a 6.35 mm lattice, which are connected to the ground plane by plated metal vias 84. The second, buried layer 74 contains 4.06 mm square patches 76 which are electrically floating, and offset from the upper layer by one-half period. The two layers of patches were separated by 0.1 mm of polyimide insulator 78. The patches in the lower layer are separated from the solid metal layer by a 5.1 mm substrate 79 preferably made of a standard fiberglass printed circuit board material commonly known as FR4. The pattern forms a lattice of coupled resonators, each of which may be thought of as a tiny LC circuit. In a geometry such as this, the proper unit for sheet capacitance is pF*square, and the proper unit for sheet inductance is nH/square. The overlap between the two layers of patches yields a sheet capacitance of about 1.2 pF*square, and the thickness of the structure provides a sheet inductance of about 6.4 nH/square. The resulting resonance frequency is:

$$f = \frac{1}{2\pi\sqrt{LC}} 1.8 \text{ GHz.}$$

The width of the band gap can be shown to be:

$$\frac{f}{\Delta f} = \frac{\sqrt{L/C}}{\sqrt{\mu_0/\varepsilon_0}} = 20\%.$$

Figure 7:
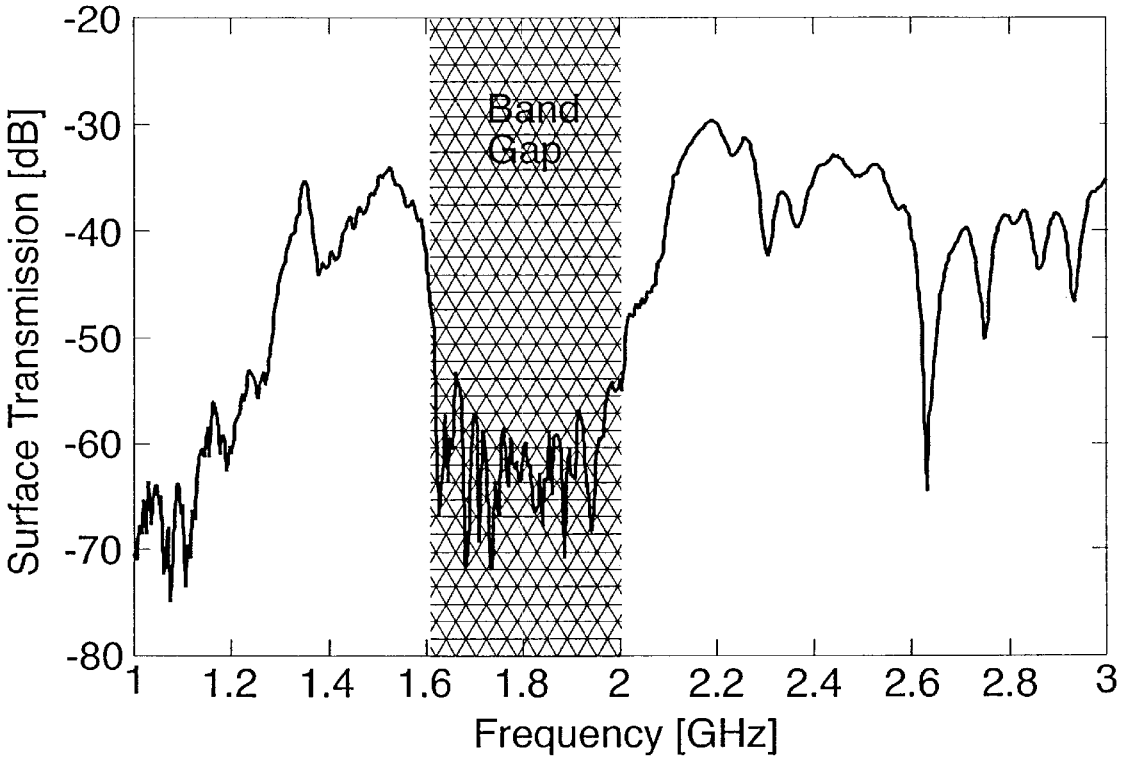
FIG. 7 is a plot of the surface wave transmission magnitude as a function of frequency for a three layer high impedance surface of FIGS. 5 and 6.

To characterize the surface wave transmission properties of this high impedance, a pair of small coaxial probes were used. The last 1.5 cm of the outer conductor was removed from two pieces of semi-rigid coaxial cable, and the exposed center conductor acted as a surface wave antenna. The plot in FIG. 7 shows the surface wave transmission magnitude as a function of frequency. Between 1.6 and 2.0 GHz, a band gap is visible, indicated by the 30 dB drop in transmitted signal. Below the band gap, the surface is inductive, and supports TM surface waves, while above the band gap it is capacitive, and supports TE surface waves. Since the probes used in this experiment are much shorter than the wavelengths of interest, they tend to excite both TM and TE polarizations, so both bands can be seen in this measurement. For frequencies within the band gap, surface waves are not bound to the surface, and instead radiate efficiently into the surrounding space. An antenna 50 placed on such a surface will behave as though it were on an infinite ground plane, since any induced surface currents are forbidden from propagating by the periodic surface texture, and never reach the ground plane edges. An antenna 50 surrounded by a region of Hi-Z surface 70 can be placed arbitrarily on the metal exterior of a vehicle, with little variation in performance. Because of surface wave suppression, it will remain partially shielded from the effects of the surrounding electromagnetic environment, such as the shape of the ground plane.

Figure 8:
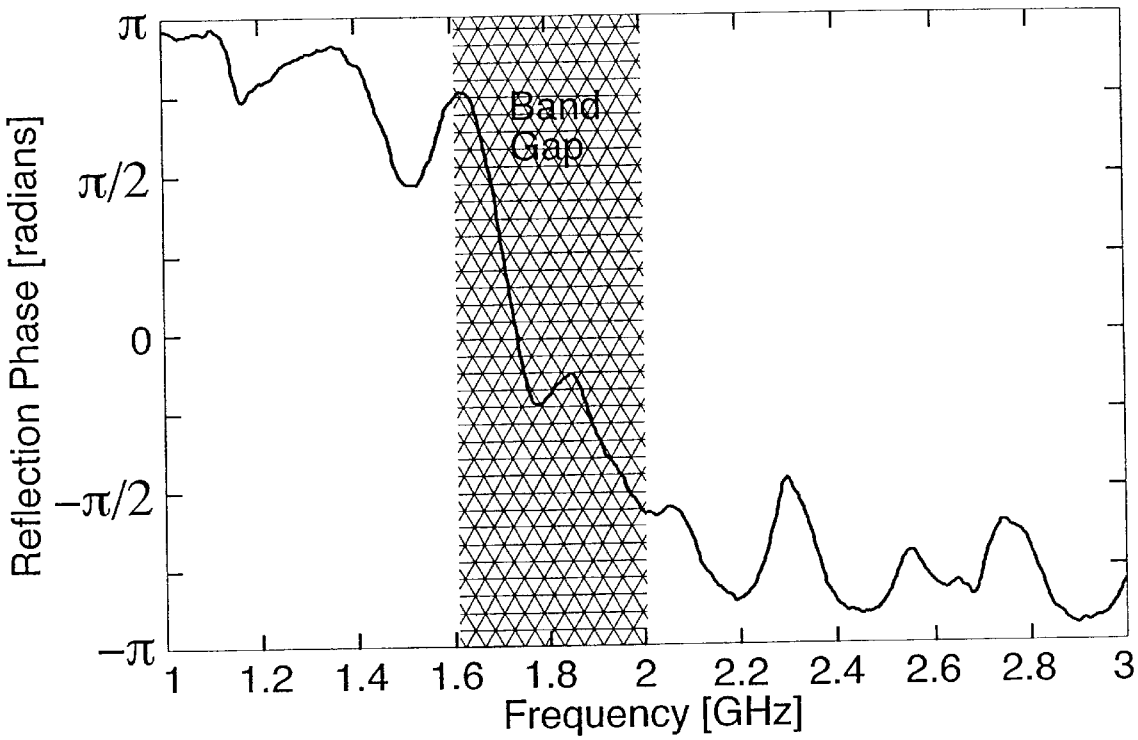
FIG. 8 is a graph of the reflection phase of the three layer high impedance surface of FIGS. 5 and 6 plotted as a function of frequency.

The reflection phase of the surface was measured using a pair of horn antennas oriented perpendicular to the surface. Microwave energy is radiated from a transmitting horn, reflected by the surface, and detected with a receiving horn. The phase of the signal is recorded, and compared with a reference scan of a smooth metal surface, which is known to have a reflection phase of $\pi$. The reflection phase of the high impedance surface is plotted as a function of frequency in FIG. 8. The surface is covered with a lattice of small resonators, which affect its electromagnetic impedance. Far below resonance, the textured surface reflects with a $\pi$ phase shift, just as an ordinary metal surface does. Near resonance, the surface supports a finite tangential electric field across the capacitors, while the tangential magnetic field is zero, leading some to call this surface an artificial "magnetic conductor". Far above resonance, the surface behaves as an ordinary metal surface, and the reflection phase approaches $-\pi$. Near the resonance frequency at 1.8 GHz, antenna 50 can be placed directly adjacent to the surface, separated by only a thin insulator 88 such as 0.8 mm thick FR4. The antenna 50 is preferably spaced a small distance (0.8 mm in this embodiment by the insulator 88) from the Hi-Z surface 70 so that the antenna 50 preferably does not interfere with the capacitance of the surface 70. Because of the high surface impedance, the antenna is not shorted out, and instead it radiates efficiently.

Assuming that one pair of elements 52 are to be excited at any given time (when using the antenna 70 to transmit) or connected to a receiver at any given time (when using the antenna 70 to receive), then the four feed points 54A, 54B, 54C and 54D may be coupled to a radio frequency switch 90 (See FIG. 4), disposed adjacent the ground plane 73, which switch 90 is coupled to the feed points 54A, 54B, 54C and 54D by short lengths 92 of a suitably shielded 50Ω cable or other means for conducting the radio frequency energy to and from the feed points through the Hi-Z surface 70 which is compatible with 50Ω signal transmission. By so connecting the antenna 50, the RF switch 90 can be used to determine in which direction 56A, 56B, 56C or 56D the antenna 50 exhibits its highest gain by a control signal applied at control point 91. The RF energy to and from the antenna is communicated via an RF port 93. Alternatively, each feed point 54A, 54B, 54C and 54D can be coupled to demodulators and power meters for sensing the strength of the received signals before selecting the strongest signal by means of a RF switch 90.

A test embodiment of the four adjacent elements 52, which form the four flared notch antennas 53, depicted by FIGS. 2 and 2*a* were disposed with their insulating substrate 88 on the test embodiment of the high impedance surface previously described with reference to FIGS. 5–8. The four antenna feed points 54A, 54B, 54C and 54D of the test embodiment were fed through the bottom of the Hi-Z surface 70 by four coaxial cables 92, from which the inner and outer conductors are connected to the left and right sides of each feed point 54. The four cables 92 were connected to a single feed by a 1×4 microwave switch 90 mounted below the ground plane 73. In commercial embodiments a miniaturized version of this microwave switch could be attached to a recessed area in the center of the circuit board to further lower the antenna profile, if desired. The Hi-Z ground plane 70 for this test was 25.4 cm square while the breadth and width 67 of antenna 50 in this test embodiment measured 23.0 cm. Each flared notch gradually spread from 0.05 cm at the feed point 54 to 8.08 cm at the extremity of the antenna. In this test embodiment, the shape of the edges 62 of the lobes 60 was defined by an ellipse having major and minor radii of 11.43 cm and 4.04 cm, respectively. The isolating slots or gaps 58, which are included to reduce coupling between adjacent elements 52, had dimensions of 0.25 cm by 3.81 cm, and the circular central region 69 had a diameter of 2.54 cm.

Figure 9:
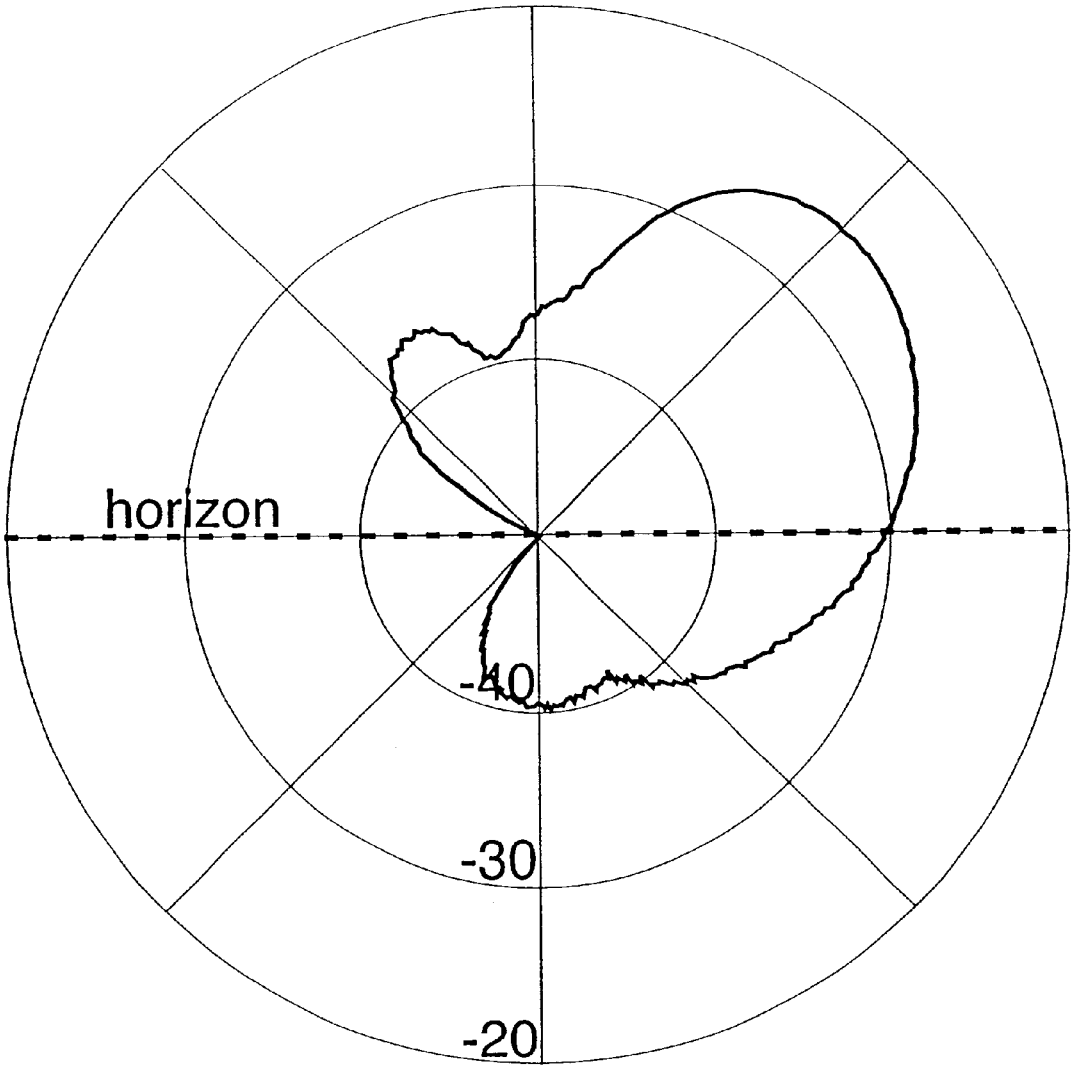
FIG. 9 is a graph of the elevation pattern of a beam radiated from a flared notch of a Vivaldi Cloverleaf antenna disposed on the high impedance surface of FIGS. 5 and 6.
Figure 10:
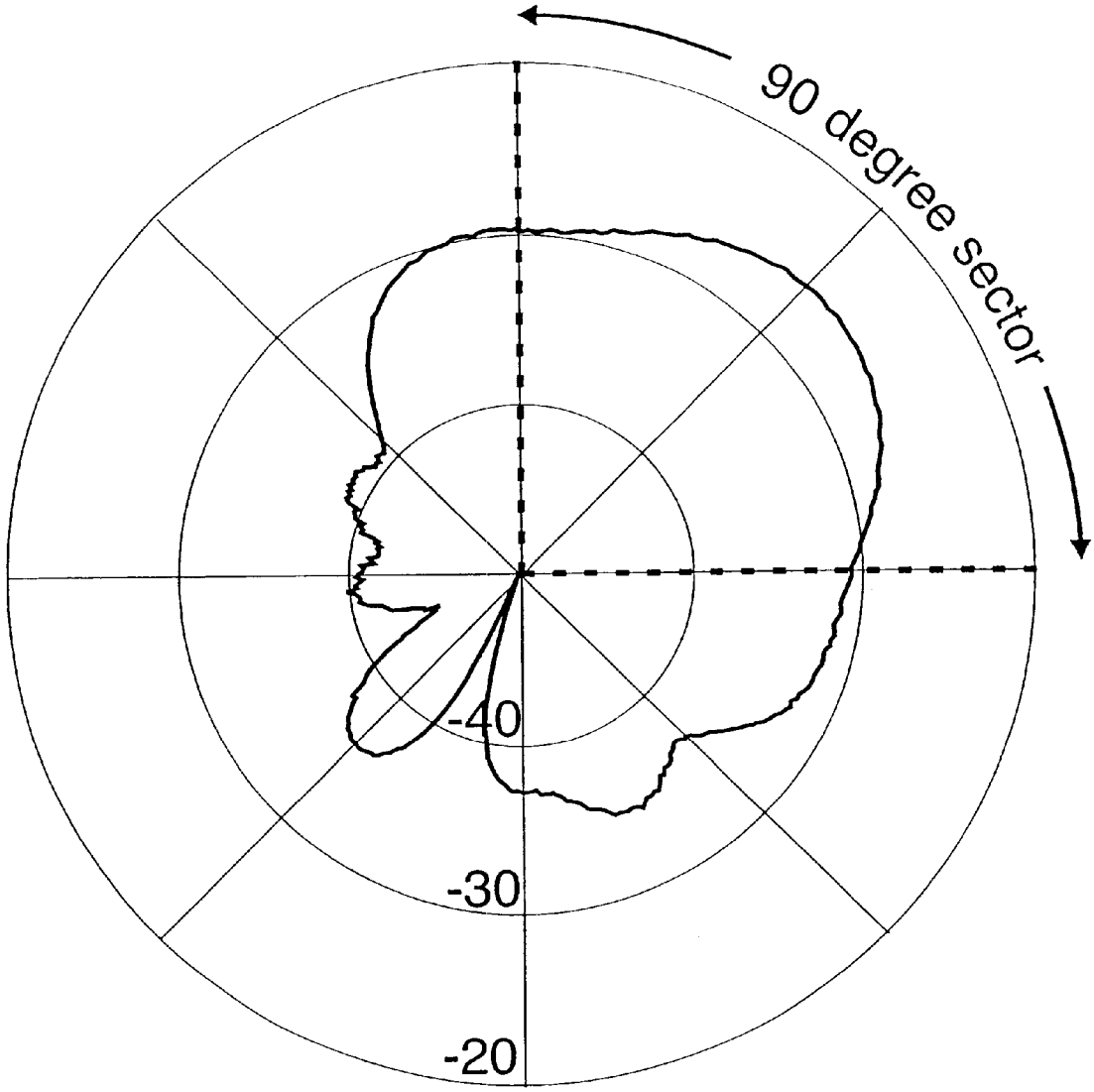
FIG. 10 is a graph of the radiation pattern taken through a 30 degree conical azimuth section of the beam transmitted from a flared notch of a Vivaldi Cloverleaf antenna disposed on the high impedance surface of FIGS. 5 and 6.

To measure the radiation pattern, this test embodiment of antenna 50 with substrate 70 was mounted on a rotary stage, and the 1×4 RF switch 90 was used to select a single beam. The radiated power was monitored by a stationary horn as the test embodiment was rotated. Each of the four notch antennas 53 radiated a horizontally polarized beam directed at roughly 30 degrees above the horizon, as shown in the elevation pattern in FIG. 9. A 30-degree conical azimuth section of the radiation pattern was then taken by raising the receiving horn and scanning in the azimuth. The conical azimuth pattern of each flared notch antenna 53 covers a single quadrant of space as shown in FIG. 10. The slight asymmetry of the pattern is due to the unbalanced coaxial feed. As such, some practicing the present invention may want to elect to use a balanced feed instead. However, we prefer an unbalance feed due to the simplicity gained by routing the signals to and from the antenna feed points 54 by means of coaxial cables.

The operating frequency and bandwidth of the antenna 50 are determined primarily by the properties of the Hi-Z surface 70 below it. The maximum gain of the antenna 50 occurred at a frequency of 1.8 GHz, near the resonance frequency of the Hi-Z surface. The gain decreased by 3 dB over a bandwidth of 10%, and by 6 dB over a bandwidth of 30%. In the elevation pattern, the angle of maximum gain varied from nearly vertical at 1.6 GHz to horizontal at 2.2 GHz. This is caused primarily by the fact that the Hi-Z surface 70 has a frequency dependent surface impedance. The azimuth pattern was more constant, and each of the four notch antennas 53 filled a single quadrant over a wide bandwidth. Specifically, the power at 45 degrees off the centerline 56 of a notch antenna 53 was between −3 and −6 dB of maximum over a range of 1.7 to 2.3 GHz.

Figure 1C:
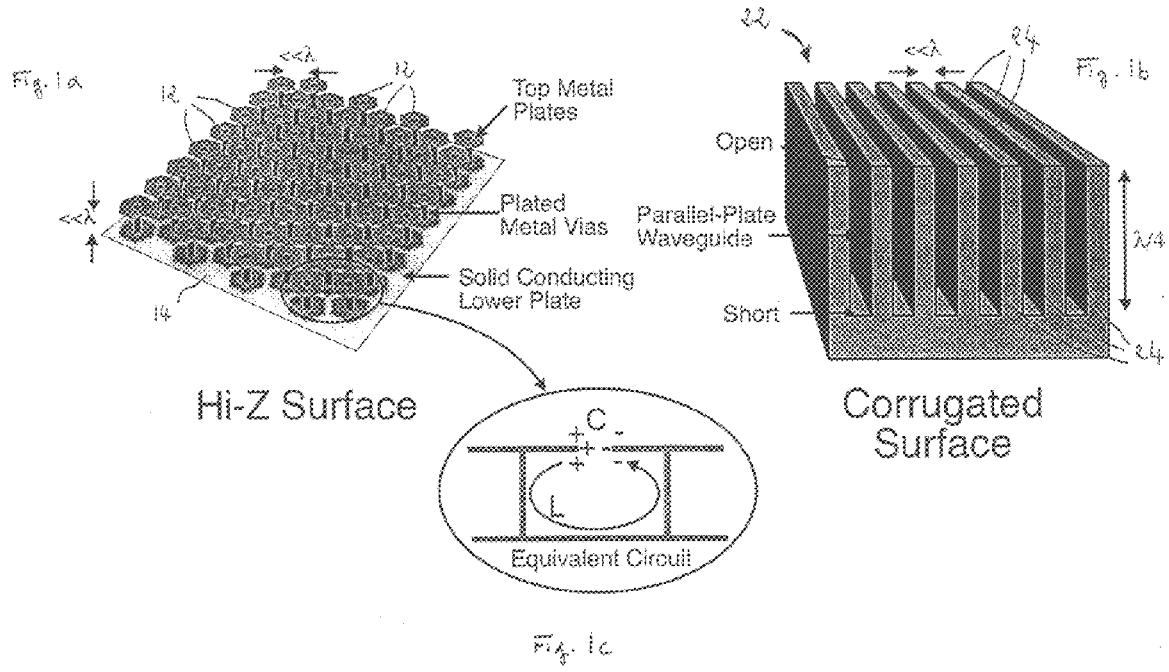
FIG. 1*c* is an equivalent circuit for a resonant element on the Hi-Z surface.
Figure 11:
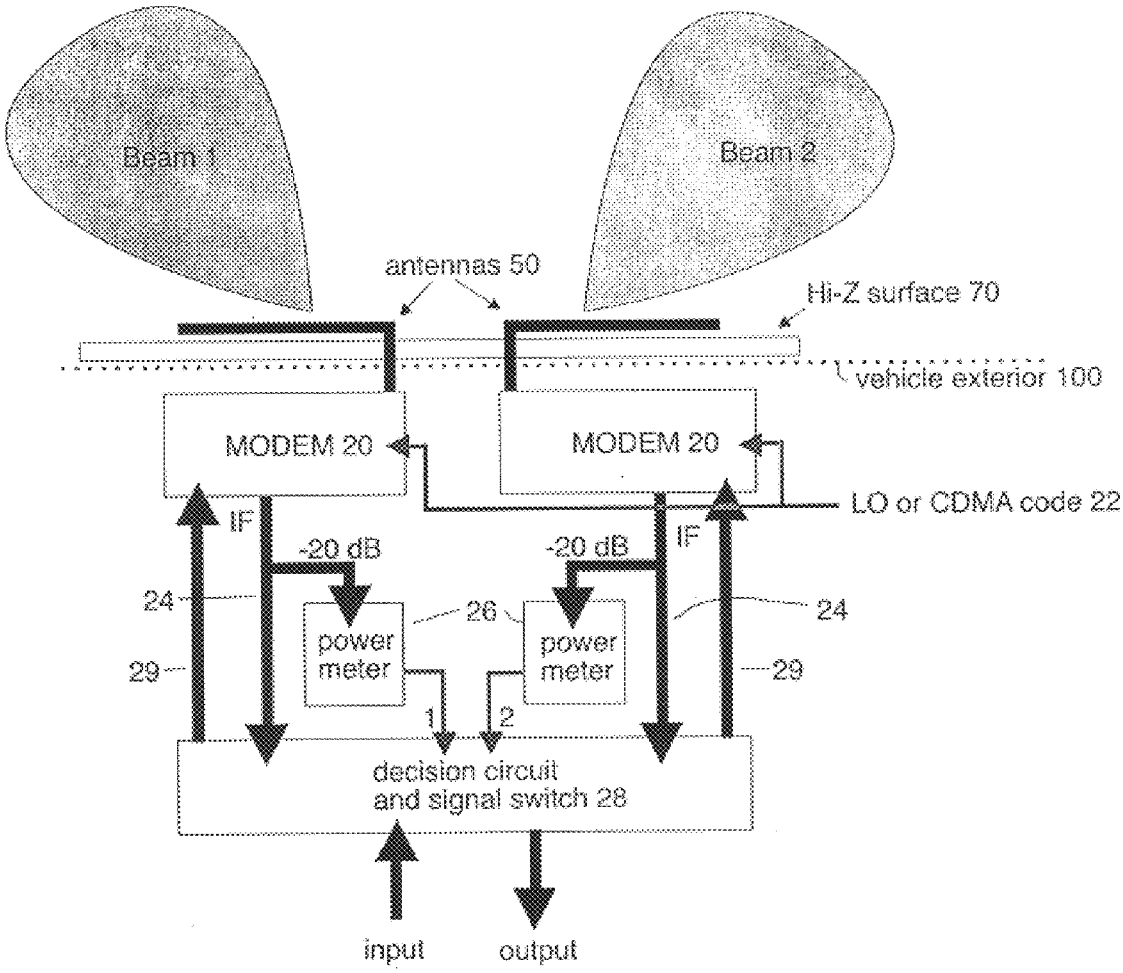
FIG. 11 is a system diagram of the low profile, switched-beam diversity antenna.

FIG. 11 is a system diagram of a low profile, switched-beam diversity antenna system, which may be conveniently used with the previously discussed Vivaldi Cloverleaf antenna 50. The elements 52 of antenna 50 are shielded from the metal vehicle exterior 100 by a high impedance (Hi-Z) surface 70 of the type depicted by FIG. 1*a* or preferably a three layer Hi-Z surface as shown and described with reference to FIGS. 5–8. The total height of the antennas 50 and the Hi-Z surface 70 is much less than a wavelength (λ) for the frequency at which the antenna normally operates. The signal from each antenna feed point 54 is demodulated at a modulator/demodulator 20 using an appropriate input frequency or CDMA code 22 to demodulate the received signal into an Intermediate Frequency (IF) signal 24. When the antenna 50 is used to transmit a RF signal, then the signal on line 29 is modulated to produce a transmitted signal. When the system of FIG. 11 is utilized as a receiver, then the power level of each IF signal 24 is then preferably determined by a power metering circuit 26, and the strongest signal from the various sectors is selected by a decision circuit 28. Decision circuit 28 includes a radio frequency switch 90 for passing the signal input and output to the appropriate feed point 54 of antenna 50 via an associated modem 20. In this embodiment, a separate modulator/demodulator 20 is associated with each feed point 54A, 54B, 54C and 54D, although only two modulator/demodulators 20 are shown for ease of illustration. Correspondingly, the antenna 50 is shown in FIG. 11 as having two beams 1,2 associated therewith. Of course, the antenna shown in FIG. 2 would have four beam associated therewith, one for each feed point 54.

Each pair of adjacent elements 52 of antenna 50 on the Hi-Z surface 70 form a notch antenna that has, as can be seen from FIG. 10, a radiation pattern that covers a particular angular section of space. Some pair of elements 52 may receive signals directly from a transmitter of interest, while others receive signals reflected from nearby objects, and still others receive interfering signals from other transmitters. Each signal from a feed point 54A, 54B, 54C and 54D is demodulated or decoded, and a fraction of each signal is split off by a signal splitter at numeral 23 to a separate power meter 25. The output from the power meter 25 is used to trigger a decision circuit 27 that switches between the outputs 13 from the various demodulators. In the presence of multipath interference, the strongest signal is selected. In the presence of other interferers, such as other users on the same network, the signal 13 with the correct information is selected. In this case, the choice of desired signal is preferably determined by a header associated with each signal frame, which identifies an intended recipient. This task is preferably handled by circuitry in the modulator/demodulators.

Figure 12:
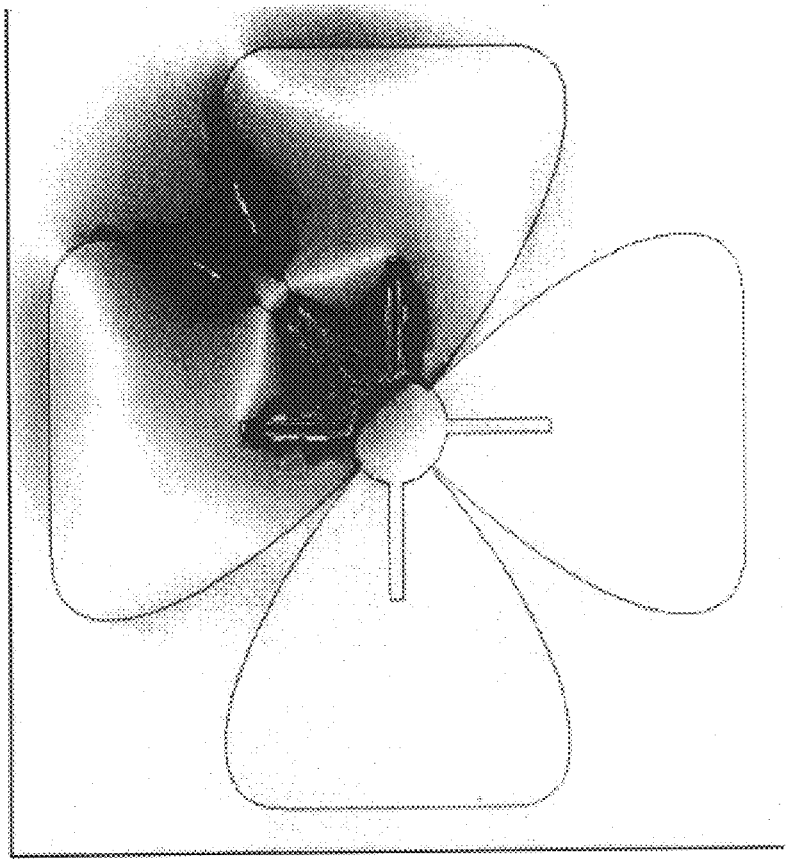
FIG. 12 depicts the electric fields that are generated by exciting one the flared notch antenna in the upper left hand quadrant of the Vivaldi Cloverleaf antenna.
Figure 13:
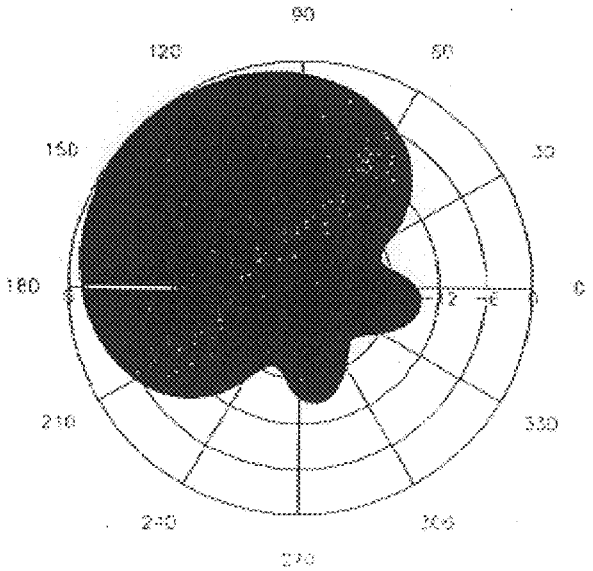
FIG. 13 depicts the radiation pattern when the feed point for the upper left hand quadrant of the Vivaldi Cloverleaf antenna is excited.

The antenna 50 has a radiation pattern that is split into several angular segments. The entire structure can be very thin (less than 1 cm in thickness) and conformal to the shape of a vehicle, for example. The antenna 50 is preferably provided by a group of four flared notch antennas 53 arranged as shown in FIG. 4. The antenna arrangement of FIG. 4 has been simulated using Hewlett-Packard HFSS software. The four rectangular slots or gaps 58 in the metal elements 52 are about one-quarter wavelength long and provide isolation between the neighboring antennas 53. The importance of the slots has been shown in the simulations. The electric fields that are generated by exciting one flared notch antenna 53 are shown in FIG. 12. The upper left quadrant is excited by a small voltage source at feed point 54D and, as can be seen, the electric fields radiate outwardly along the flared notch section. They also radiate inwardly, along the edges of the circular central region 69, but they encounter the rectangular slots 58 that effectively cancel out the currents. The result is a radiation pattern covering one quadrant of space, as shown in FIG. 13. Exciting the other three feed points 54A, 54B, 54C in a similar manner allows one to cover 360 degrees. More than four elements 52 could be provided to achieve finer beamwidth control.

The switched beam diversity and the Hi-Z surface technology discussed with reference to FIG. 11 may be conveniently used with the Vivaldi Cloverleaf antenna 50, but the Vivaldi Cloverleaf antenna 50 can certainly be used in other applications. For example, it can be used in free space and as such it need not necessarily be used on a Hi-Z surface. Additionally other techniques for driving the Vivaldi Cloverleaf antenna will now become apparent to those skilled in the art. The antenna could certainly used in used in receive only or transmit only applications. The Vivaldi Cloverleaf antenna 50 has certain advantages: (1) it generates a horizontally polarized RF beam which (2) can be directionally controlled (3) without the need to physically re-orientate the antenna and (4) the antenna can be disposed adjacent to a metal surface such as that commonly found on the exteriors of vehicles when used with a Hi-Z surface. Of course, those skilled in the art may elect to take advantage of some features of the Vivaldi Cloverleaf antenna and not other features.

Having described this invention in connection with a preferred embodiment, modification will now certainly suggest itself to those skilled in the art. As such, the invention is not to be limited to the disclosed embodiments except as required by the appended claims.

What is claimed is:

1. An antenna comprising a plurality of flared notch antennas disposed immediately adjacent each other, each flared notch antenna having a direction of maximum gain which is directed in a different direction for each flared notch antenna, each flared notch antenna being defined by a pair of confronting elements, each said element being associated with two different ones of said plurality of flared notch antennas and each said element having a gap therein, said gap having a length which is approximately equal to a quarter wave length of a radio frequency signal to be received and/or transmitted by the antenna.

2. The antenna of claim 1 further including a high impedance surface, said plurality of flared notch antennas disposed immediately adjacent to said high impedance surface.

3. The antenna of claim 2 wherein the high impedance surface includes a conductive back plane on one surface thereof and a plurality of conductive elements of a second surface thereof, the second elements each having a maximum size which is substantially less than the length of the gaps in said confronting elements.

4. The antenna of claim 3 wherein the plurality of flared notch antennas comprise a plurality of vivaldi antennas.

5. The antenna of claim 4 wherein each confronting element is a generally planar conductive element which extends generally from a central region to an outer extremity with the width of each element increasing over a majority of the distance from the central region to the outer extremity and wherein each element is interrupted by said gap in a region thereof adjacent said central region.

6. The antenna of claim 5 wherein each confronting element gradually increases in width over said majority of the distance from the central region to the outer extremity.

7. The antenna of claim 6 wherein each confronting element has an inner extremity which defines a portion of a circle and wherein the plurality of confronting elements are arranged such that their inner extremities define a common circle with said gaps being disposed generally radially with respect to said common circle.

8. The antenna of claim 7 wherein an edge of each confronting element gradually departs away from an edge of an adjacent element and a feed point of one of said flared notch antennas is defined where the edges of adjacent elements most closely approach each other.

9. The antenna of claim 8 wherein said edges of the confronting elements define portions of ellipses.

10. The antenna of claim 2 wherein the high impedance surface comprises an insulating layer including an array of conductive regions, the conductive regions being spaced from adjacent ones of said conductive regions and each conductive region having an area less than 0.01 times the area of one of said elements.

11. The antenna of claim 10 wherein the high impedance surface further includes an conductive ground plane disposed in a uniformly spaced relationship to said array of conductive regions.

12. The antenna of claim 11 wherein the high impedance surface further includes a second array of conductive regions, the conductive regions of the second array being spaced from adjacent ones of said conductive regions of the second array and each conductive region of the second array having an area less than 0.01 times the area of one of said elements.

13. The antenna of claim 12 further including a plurality of conductive elements coupling each of the conductive regions of said second array to said ground plane.

14. The antenna of claim 11 wherein each conductive region is rectilinear.

15. An antenna comprising: a plurality of Vivaldi flared notch antennas disposed in an array, each Vivaldi Flared notch antenna being formed by two generally planar conductive elements disposed in a confronting relationship with a feed point being defined therebetween and each Vivaldi flared notch antenna sharing each of its two planar elements with a different adjacent Vivaldi flared notch antenna.

16. The antenna of claim 15 wherein each element is defined as a generally planar conductive element which extends generally from a central region to an outer extremity with the width of each element increasing over a majority of the distance from the central region to the outer extremity and wherein each element is interrupted by a gap therein in a region thereof adjacent said central region.

17. The antenna of claim 16 wherein each element smoothly increases in width over said majority of the distance from the central region to the outer extremity.

18. The antenna of claim 17 wherein each element has an inner extremity which defines a portion of a circle and wherein the plurality of elements are arranged such that their inner extremities define a common circle with said gaps being disposed generally radially with respect to said common circle.

19. The antenna of claim 18 wherein an edge of each element gradually departs away from an edge of an adjacent element and a feed point of one of said flared notch antennas is defined where the edges of adjacent elements most closely approach each other.

20. The antenna of claim 19 wherein said edges of the elements define portions of ellipses.

21. The antenna of claim 15 further including a high impedance surface disposed adjacent said array, said high impedance surface comprising an insulating substrate.

22. The antenna of claim 21 wherein the high impedance surface also comprises an insulating layer including an array of conductive regions, the conductive regions being spaced from adjacent ones of said conductive regions and each conductive region having an area less than 0.01 times the area of one of said elements.

23. The antenna of claim 22 wherein the high impedance surface further includes an conductive ground plane disposed in a uniformly spaced relationship to said array of conductive regions.

24. The antenna of claim 23 wherein the high impedance surface further includes a second array of conductive regions, the conductive regions of the second array being spaced from adjacent ones of said conductive regions of the second array and each conductive region of the second array having an area less than 0.01 times the area of one of said elements.

25. The antenna of claim 23 further including a plurality of conductive elements wherein coupling each of the conductive regions of said second array to said ground plane.

26. The antenna of claim 22 wherein the conductive regions in said array of conductive regions are sized so that said high impedance surface has a zero phase shift for said radio frequency wave.

27. The antenna of claim 22 wherein each conductive region is rectilinear.

28. An antenna for receiving and/or transmitting a radio frequency wave, the antenna comprising: a plurality of flared notch antennas disposed adjacent to each other and arranged such that their directions of maximum gain point in different directions, each of the flared notch antennas being associated with a pair of radio frequency radiating elements and wherein each radio frequency radiating element serves as a radio frequency radiating element for two different flared notch antennas and has a gap therein having a length equal to approximately one quarter wavelength of the radio frequency wave.

29. The antenna of claim 28 wherein each element is a generally planar conductive element which extends generally from a central region to an outer extremity with the width of each element increasing over a majority of the distance from the central region to the outer extremity and wherein each element is interrupted by a gap therein in a region thereof adjacent said central region.

30. The antenna of claim 29 wherein each element gradually increases in width over said majority of the distance from the central region to the outer extremity.

31. The antenna of claim 30 wherein each element has an inner extremity which defines a portion of a circle and wherein the plurality of elements are arranged such that their inner extremities define a common circle with their gaps being disposed generally radially with respect to said common circle.

32. The antenna of claim 31 wherein an edge of each element gradually departs away from an edge of an adjacent element and a feed point of one of said flared notch antennas is defined where the edges of adjacent elements most closely approach each other.

33. The antenna of claim 32 wherein said edges of the elements define portions of ellipses.

34. The antenna of claim 33 wherein said plurality of flared notch antennas are disposed an insulating substrate.

35. A directional antenna comprising four flared notch antennas disposed immediately adjacent each other, each flared notch antenna having a different direction of maximum gain which direction is arranged at approximately a ninety degree angle relative to the direction of maximum gain for each adjacent flared notch antenna, each flared notch antenna of said four flared notch antennas being coupled to receive a radio wave signal arriving along its direction of maximum gain and to direct the received radio signal to a switch.

36. The directional antenna of claim 35 further including a high impedance surface, said flared notch antennas disposed immediately adjacent to said high impedance surface.

37. The directional antenna of claim 36 wherein the high impedance surface includes a conductive back plane on one surface thereof and a plurality of conductive elements of a second surface thereof, the second elements each having a maximum size which is substantially less than a length of the notches of said flared notch antennas.

38. The directional antenna of claim 36 wherein each flared notch antenna is defined by a pair of confronting elements, each said confronting element being associated with two different ones of said four flared notch antennas and wherein the high impedance surface comprises an insulating layer including a regular repeating array of conductive regions, the conductive regions being spaced from adjacent ones of said conductive regions and each conductive region having an area less than 0.01 times the area of one of said confronting elements.

39. The directional antenna of claim 38 wherein the high impedance surface further includes an conductive ground plane disposed in a uniformly spaced relationship to said array of conductive regions.

40. The directional antenna of claim 39 wherein the high impedance surface further includes a second array of conductive regions, the conductive regions of the second array being spaced from adjacent ones of said conductive regions of the second array and each conductive region of the second array having an area less than 0.01 times the area of one of said elements.

41. The directional antenna of claim 40 further including a plurality of conductive elements coupling each of the conductive regions of said second array to said ground plane.

42. The directional antenna of claim 39 wherein the conductive regions is said array of conductive regions are sized so that said high impedance surface has a zero phase shift for said radio frequency wave.

43. The directional antenna of claim 39 wherein each conductive region is rectilinear.

44. The antenna of claim 39 wherein the conductive regions in said array of conductive regions are sized so that said high impedance surface has a zero phase shift for said radio frequency wave.

45. The directional antenna of claim 38 wherein the plurality of flared notch antennas comprise a plurality of vivaldi antennas.

46. The directional antenna of claim 45 wherein each confronting element is a generally planar conductive element which extends generally from a central region to an outer extremity with the width of each element increasing over a majority of the distance from the central region to the outer extremity and wherein each element is interrupted by a gap in a region thereof adjacent said central region.

47. The directional antenna of claim 46 wherein each confronting element gradually increases in width over said majority of the distance from the central region to the outer extremity.

48. The directional antenna of claim 47 wherein each confronting element has an inner extremity which defines a portion of a circle and wherein the plurality of confronting elements are arranged such that their inner extremities define a common circle with the gaps being disposed generally radially with respect to said common circle.

49. The directional antenna of claim 48 wherein an edge of each confronting element gradually departs away from an edge of an adjacent element and a feed point of one of said flared notch antennas is defined where the edges of adjacent elements most closely approach each other.

50. The directional antenna of claim 49 wherein said edges of the confronting elements define portions of ellipses.

51. A directional antenna comprising: a plurality of identical flared notch antennas disposed in a regular repeating array of identical flared notch antennas, each flared notch antenna having a different direction of maximum gain and each flared notch antenna being formed by two edges of conductive elements, the edges thereof being disposed in a confronting relationship with a feed point being defined therebetween, and each flared notch antenna receiving in incoming radio frequency signal along its direction of maximum gain.

52. The directional antenna of claim 51 wherein each element is defined as a generally planar conductive element which extends generally from a central region to an outer extremity with the width of each element increasing over a majority of the distance from the central region to the outer extremity and wherein each element is interrupted by a gap therein in a region thereof adjacent said central region.

53. The directional antenna of claim 52 wherein each element smoothly increases in width over said majority of the distance from the central region to the outer extremity.

54. The directional antenna of claim 53 wherein each element has an inner extremity which defines a portion of a circle and wherein the plurality of elements are arranged such that their inner extremities define a common circle with said gaps being disposed generally radially with respect to said common circle.

55. The directional antenna of claim 54 wherein an edge of each element gradually departs away from an edge of an adjacent element and a feed point of one of said flared notch antennas is defined where the edges of adjacent elements most closely approach each other.

56. The directional antenna of claim 55 wherein said edges of the elements define portions of ellipses.

57. The directional antenna of claim 51 further including a high impedance surface disposed adjacent said array, said high impedance surface comprising an insulating substrate.

58. The directional antenna of claim 57 wherein the high impedance surface also comprises an insulating layer including an array of conductive regions, the conductive regions being spaced from adjacent ones of said conductive regions and each conductive region having an area less than 0.01 times the area of one of said elements.

59. The directional antenna of claim 58 wherein the high impedance surface further includes an conductive ground plane disposed in a uniformly spaced relationship to said array of conductive regions.

60. The directional antenna of claim 59 wherein the high impedance surface further includes a second array of conductive regions, the conductive regions of the second array being spaced from adjacent ones of said conductive regions of the second array and each conductive region of the second array having an area less than 0.01 times the area of one of said elements.

61. The directional antenna of claim 59 further including a plurality of conductive elements wherein coupling each of the conductive regions of said second array to said ground plane.

62. The directional antenna of claim 58 wherein the conductive regions in said array of conductive regions are sized so that said high impedance surface has a zero phase shift for said radio frequency wave.

63. The directional antenna of claim 58 wherein each conductive region is rectilinear.

* * * * *